United States Patent [19]

Bohlen et al.

[11] Patent Number: 4,508,992

[45] Date of Patent: Apr. 2, 1985

[54] MICROWAVE AMPLIFIER TUBE HAVING TWO RING RESONATORS

[75] Inventors: Heinz Bohlen, Hamburg; Enzio Demmel, Quickborn, both of Fed. Rep. of Germany

[73] Assignee: U.S. Philips Corporation, New York, N.Y.

[21] Appl. No.: 394,594

[22] Filed: Jul. 2, 1982

[30] Foreign Application Priority Data

Jul. 2, 1981 [DE] Fed. Rep. of Germany ..... 3126119

[51] Int. Cl.[3] ..... H01J 23/18; H01J 25/04

[52] U.S. Cl. ..... 315/5.39; 315/5.25; 315/5.27; 315/5.28; 315/5.41

[58] Field of Search ..... 315/5.39, 5.41, 39.53, 315/5.25, 5.24, 5.26, 5.27, 5.28; 330/45, 56; 328/227

[56] References Cited

U.S. PATENT DOCUMENTS 3,921,027 11/1975 Shelton et al. ..... 315/5.39

FOREIGN PATENT DOCUMENTS 1060923 7/1959 Fed. Rep. of Germany ..... 315/5.39

OTHER PUBLICATIONS

K. K. N. Chang, "Electron Beam Amplifier", RCA Technical Notes, No. 393, Jun. 1960.

*Primary Examiner*—David K. Moore
*Assistant Examiner*—Vincent DeLuca
*Attorney, Agent, or Firm*—Robert J. Kraus

[57] ABSTRACT

A microwave amplifier tube having a first and a second ring resonator of which the first serves as a driver resonator and the second serves as an output resonator. By means of a cathode system an electron beam rotating about the ring axis at the frequency of a control signal is generated. The electron beam is accelerated by a direct voltage and enters the second ring resonator which is tuned to the same frequency as the first resonator. The electron beam influences a high-frequency electromagnetic field in the second resonator and delivers a part of its energy to said second resonator. In order to facilitate equalization of the angular phase velocities in the two resonators, the ring resonators are provided above each other in the direction of the ring axis and the electron beam passes through the first and the second ring resonator parallel to the ring axis.

11 Claims, 2 Drawing Figures

MICROWAVE AMPLIFIER TUBE HAVING TWO RING RESONATORS

BACKGROUND OF THE INVENTION

The invention relates to a microwave amplifier tube having a first and a second ring resonator of which the first serves as a driver resonator and the second serves as an output resonator. By means of a cathode system an electron beam rotating around the ring axis at the frequency of a control signal is generated. The electron beam is accelerated by a direct voltage and enters the second ring resonator which is tuned to the same frequency as the first resonator. The electron beam influences a high-frequency electromagnetic field in the second resonator and delivers a part of its energy to said second resonator.

A microwave amplifier tube of this type is known from U.S. Pat. No. 4,210,845. This patent is hereby incorporated by reference to provide background information on the functioning of such highly efficient very high power microwave amplifiers.

In the known tube termed "Trirotron" a cathode provided in a ring resonator serves as a source for a radially-directed, rotating, spoke-shaped electron beam. By means of a biased grid at the emanating gap of the resonator it is achieved that electrons leave the control resonator only at the place of the rotating maximum of the electric field strength. These electrons are then accelerated by a high electrostatic field and enter the output ring resonator.

In such a microwave amplifier tube having two concentrically arranged ring resonators it is difficult to operate the resonators at the same angular phase velocity. Furthermore, in such a tube the focusing of the electron beam is difficult because the resonators are arranged concentrically with respect to each other.

SUMMARY OF THE INVENTION

It is an object of the invention to construct a microwave amplifier tube of the kind mentioned in the opening paragraph so that the equalisation of the angular phase velocities of the two resonators is not complicated by the geometry of the tube and so that its maximum operating frequency is increased.

According to the invention this object is achieved by arranging the ring resonators above each other in the direction of the ring axis such that the electron beam passes through the first ring resonator and the second ring resonator parallel to the ring axis. This arrangement not only simplifies equalisation of the angular phase velocities of the two resonators but, since the cathode is no longer concentric in the control resonator, the upper frequency limit of the tube is increased. The arrangement also enables use of an axis-parallel magnetic field for focusing the electron beam, which can be provided by means of conventional methods, so that electron beams of high space charge (i.e. low voltage) may be used.

By means of a tube according to the invention an efficiency in the amplification of HF signals can be achieved ($<80\%$) which lies clearly above the value which can be achieved by means of klystrons.

BRIEF DESCRIPTION OF THE DRAWING

Two embodiments will hereinafter be explained in greater detail with reference to the accompanying drawing.

DESCRIPTION OF THE PREFERRED EMBODIMENTS

Figure 1:
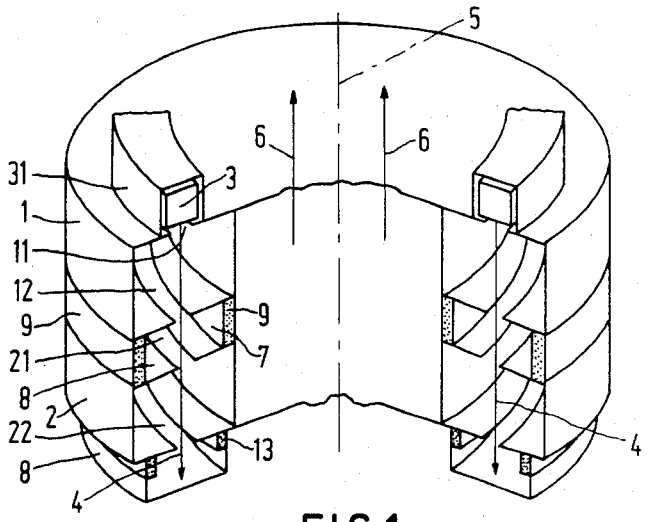
FIGS. 1 and 2 of the drawing each show, partly as a sectional view, a respective microwave amplifier tube embodiment according to the invention.

The tube embodiment consists of two ring resonators 1 and 2 which are situated above each other and at a distance from each other. The ring resonators are connected together by means of an insulating ring 9 so that an accelerating path 7 is formed between the ring resonators. The first ring resonator 1 has an annular cathode 3 (FIG. 1) or 3*a* (FIG. 2) provided in envelope 31 (FIG. 1) or 32 (FIG. 2) respectively.

Figure 2:
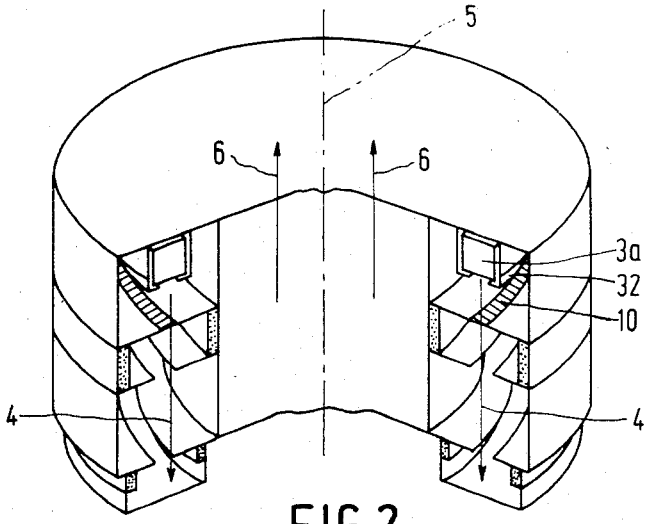

The cathode arrangement may be accommodated outside the first ring resonator 1, as is shown in FIG. 1 by the arrangement 3, 31 which is then provided with an entrance gap 11, or may be provided inside the first ring resonator 11 as is shown in FIG. 2 by the arrangement 3*a*, 32.

The active cathode surface of the cathode arrangement may form either a closed ring or may be composed of segments.

The electron beam 4 emanates from the cathode arrangement parallel to the common axis of the ring resonators 1 and 2 when the HF amplitude in the first ring resonator is sufficiently large. When the HF-amplitude in the first ring resonator or input resonator 1, to which the control signal is supplied is sufficiently large, the electrons emanate from the resonator. By a positive bias between the cathode arrangement 3 and the input resonator 1, and if desired further by a control grid 10 which may be provided in the emanating gap 12 of the first ring resonator, it can be achieved that electrons emanate only at the place of the maximum electric HF-field.

The modulated electron beam 4 then leaves the first ring resonator 1 through the output gap 12.

In the electrostatic field of the accelerating path 7 between the first and second ring resonators 1 and 2, respectively, the electron beam 4 is accelerated and then enters the second ring resonator 2, the output resonator, through an input gap 21.

The output energy is coupled out from the second ring resonator and the electron beam 4 leaves the second ring resonator 2 via the output gap 22 and is received by an annular collector 8 biased at a voltage which is lower than the voltage at the output resonator. When the residual energy of the electron beam 4 is small enough that it can be collected by the second ring resonator 2, the output gap 22 and the collector 8 may be omitted. In that case the electron beam 4 impinges on the bottom of the second ring resonator 2.

A magnetic field 6 which is parallel to the ring axis for focusing the electron beam 4 can be produced by means of conventional methods, for example by inserting the tube into an annular magnet. As a result of that it is possible to use an electron beam of high space charge, that is to say of low accelerating voltage with high beam current.

A C.W. output power of a few MW at a frequency of 500 MHz can be achieved with a tube of the type described.

What is claimed is:

1. A microwave amplifier tube comprising:

(a) a ring-shaped cathode disposed about an axis for emitting electrons in a direction parallel to said axis;

(b) a ring-shaped input resonator for receiving a microwave input signal, said input resonator being disposed about the axis, being arranged relative to the cathode to enable emitted electrons to pass through the resonator, and having an annular output slot for enabling said emitted electrons to leave the resonator in a direction parallel to the axis, said input signal effecting formation of the emitted electrons into a beam which leaves the resonator through the annular output slot and rotates around said axis;

(c) a ring-shaped output resonator for producing a microwave output signal, said output resonator being disposed about the axis and having an annular input slot axially-spaced from said annular output slot for enabling the electron beam to enter the output resonator and effect production of said output signal; and (d) collector means for collecting the electrons in the beam after the beam enters the output resonator.

2. A microwave amplifier tube as in claim 1 including means for producing a magnetic field extending parallel to the axis.

3. A microwave amplifier tube as in claim 2 where said means for producing a magnetic field comprises a ring-shaped magnet.

4. A microwave amplifier tube as in claim 1 where said collector means comprises:

(a) an annular output slot in the output resonator for enabling the electron beam to leave the output resonator; and (b) an annular collector axially-spaced from the annular output slot in the output resonator for collecting the electrons in the beam after the beam leaves the output resonator.

5. A microwave amplifier tube as in claim 4 where the annular collector is electrically-insulated from the output resonator.

6. A microwave amplifier tube as in claim 1 where the input resonator includes an annular control grid axially-spaced from the cathode.

7. A microwave amplifier tube as in claim 6 where the annular control grid is disposed at the annular output slot in the input resonator.

8. A microwave amplifier tube as in claim 1 where the input resonator includes an annular input slot disposed opposite the annular output slot therein, and where the ring-shaped cathode is located outside the input resonator and is axially-spaced from said annular input slot thereof.

9. A microwave amplifier tube as in claim 1, 6 or 7 where the cathode is disposed inside the input resonator and is axially-spaced from the annular output slot thereof.

10. A microwave amplifier tube as in claim 1 where the cathode is in the form of a continuous ring.

11. A microwave amplifier tube as in claim 1 where the cathode is in the form of a segmented ring.

* * * * *